United States Patent [19]

Cahill

[11] 4,285,426

[45] Aug. 25, 1981

[54] CONTAINER REDEMPTION APPARATUS AND PROCESS

[75] Inventor: John W. Cahill, Yorktown Heights, N.Y.

[73] Assignee: PepsiCo Inc., Purchase, N.Y.

[21] Appl. No.: 6,437

[22] Filed: Jan. 25, 1979

[51] Int. Cl.[3] ..... G07F 7/06

[52] U.S. Cl. ..... 194/4 C; 100/902; 194/1 E; 241/99

[58] Field of Search ..... 194/1 E, 1 R, 4 B, 4 C, 194/4 D, 4 E, 4 F, 4 G, 4 R; 100/DIG. 2; 209/524, 538; 232/43.3; 241/99

[56] References Cited

U.S. PATENT DOCUMENTS

| | | | |
|---|---|---|---|
| 2,908,440 | 10/1959 | Gurewitz | 194/4 F X |
| 3,039,583 | 6/1962 | Menefee | 194/4 C |
| 3,412,837 | 11/1968 | Myers | 194/4 R |
| 3,430,766 | 3/1969 | Stone | 209/524 |
| 3,827,351 | 8/1974 | Rosenow | 100/DIG. 2 X |
| 3,857,334 | 12/1974 | Arp | 100/DIG. 2 X |
| 4,059,050 | 11/1977 | Davis, Jr. | 100/DIG. 2 X |

FOREIGN PATENT DOCUMENTS

| | | | |
|---|---|---|---|
| 52-498 | 1/1977 | Japan | 194/4 C |

*Primary Examiner*—Robert J. Spar
*Assistant Examiner*—Edward M. Wacyra
*Attorney, Agent, or Firm*—Scully, Scott, Murphy & Presser

[57] ABSTRACT

A redemption apparatus or system and process for accepting the return of selected types of non-refillable containers, and issuing to the customer a cash return or a coupon redeemable at a store for the face value printed thereon. In one embodiment of the invention the redemption system includes an open round carousel turntable having circumferentially separated compartments thereon in which a customer places a returned bottle or can. The returned container is placed on the carousel with a code thereon, which may be of UPC type, facing radially outwardly therefrom such that rotation of the carousel results in movement of the code past a code reader within the redemption apparatus which scans and detects the code markings. When the code markings indicate the returned container to be one of an acceptable type, the machine sweeps the container from the carousel into a comminuter or a shredder wherein it is comminuted and the remains thereof stored in a bin either within the machine or separate and remote therefrom. A separate register for each distributor of acceptable containers is provided.

21 Claims, 17 Drawing Figures

CONTAINER REDEMPTION APPARATUS AND PROCESS

BACKGROUND OF THE INVENTION

1. Field of the Invention

The present invention relates generally to a redemption system and, more particularly, pertains to redemption systems of the type adapted to accept the return of selected types of used returnable containers of the plastic or metal non-refillable class, and to issue or refund a premium to a customer in the form of either a cash return or a printed coupon redeemable at a retail establishment.

As a consequence of the enactment of legislative bills and ordinances in various states or municipalities requiring the return of used beverage containers, and proscribing the sale of nonreturnable containers predicated on anti-litter grounds, the handling of returned containers for purposes of recycling or the like, such as bottles and cans, has become a major problem in many geographical areas. Some states have mandated that a deposit be placed on beverage containers, and the handling and logistics of these collectively bulky items are or will be causing major difficulties for the suppliers of these products, and also constitute a burden on many retail establishments. It is not at all impossible for a wholesale delivery driver of these products to necessarily spend several nonprofitable and nonproductive hours each day sorting used containers at various retail outlets. In addition thereto, many retail outlets must frequently devote an inordinately disproportionate portion of their available floor space and personnel to the collection, storage and occasional sorting of returned containers. As a result, it is extremely desirable to have readily available, at suitable locations easily accessible to retail establishment customers, a redemption machine to return non-refillable containers which is adapted to accept the return of predetermined or selected types of containers such as, for instance, beverage cans or bottles, and which will refund to the returnor a premium in the form of either a monetary deposit refund or a coupon redeemable at a retail store for an amount in money or merchandise credit printed thereon. It is also desirable to have a redemption machine of that nature which has the capability of recording the number of returned containers of each acceptable type. When the acceptable types of containers represent different products from different distributors, the recorded information enables the refund paid out by the machine to be charged against the proper distributor. The automation of this accounting function combined with the shredding also eliminates the possibility of theft at the retail outlet and collecting double deposits against the distributor.

2. Discussion of the Prior Art

Heretofore, various types of arrangements or machines have been disclosed or suggested in the prior art relating to the facilitation of handling returnable, recyclable containers, and particularly beverage containers of several different types. Myers U.S. Pat. No. 3,412,837, Arp U.S. Pat. Nos. 3,792,765 and 3,857,334 and Tanaka U.S. Pat. No. 3,907,087 all disclose machines for accepting and compacting returned containers incorporating select characteristics. Containers, such as metal cans, are accepted and processed by the machines, and a token is dispensed to the returnor for each returned container. In these prior art arrangements, the returned containers are crushed or compacted prior to being placed in a storage receptacle, thus providing an increase in the storage capacity of the machines. The returned containers are checked to determine if they have selected physical characteristics such as a predetermined size, shape, weight, etc. However, it is an important drawback that these prior art machines are not possessed of the selectivity or versatility required for the types of applications for which the present invention was developed and, in particular, these prior art machines are not capable of ascertaining if a container in an acceptable type by scanning code markings thereon. Furthermore, these prior art machines cannot record transactions and accrue debit to the appropriate distributor for the returned containers so as to necessitate the returned containers being stored in a more space-consuming and uneconomical manner, while also rendering their removal from the stored location in the retail establishment much more cumbersome.

One prior art arrangement which is more selective than most is disclosed in Menefee U.S. Pat. No. 3,039,583 which relates to a machine designed to dispense containers of milk and which is also adapted to accept the return of empty milk containers within the machine. Each milk container has a keyhole formed in its bottom, and the machine includes a complementary key which is inserted into the keyhole to ascertain if the container being processed is acceptable. If the container is not acceptable, a reject receptacle at the front of the machine returns the rejected milk container to the customer.

In another area of technology, Herrin U.S. Pat. No. 3,752,963; Yoneyama U.S. Pat. No. 3,985,999; Rabedeau U.S. Pat. No. 3,947,816; Chadima, Jr., et al. U.S. Pat. No. 3,991,299; and Hobart U.S. Pat. No. 3,995,166 all disclose different types of systems for scanning various kinds of markings, typically in the form of universal product code (UPC) symbols imprinted on a product, which will provide information with great specificity and accuracy as to the type, nature and manufacturer or origins thereof. However, none of these patents discloses the use of scanning equipment of this nature in a redemption arrangement wherein used containers of selected types, such as beverage cans or bottles, are accepted (or rejected) by a machine in response to scanned UPC symbol information provided on the container.

Copending U.S. patent application Ser. No. 886,333, filed Mar. 13, 1978, and assigned to a common assignee, discloses a more selective approach for an apparatus which accepts the return of selected types of used containers and dispenses compensation for the return of an approved type of container. In this disclosed arrangement, a returned container is placed into a depository in the machine so as to enable a scanner to read code markings on the container, however, the scanner cannot read indicia arranged at different levels. If the code indicates the container is of an acceptable type, actuating mechanism causes the container to be deposited in a storage receptacle within which the containers are periodically compacted. The arrangement disclosed therein compacts, rather than shreds, the accepted returned containers, and accordingly stores the returned and compacted containers in a less efficient manner than if the containers were comminuted. Furthermore, the present invention differs from this arrangement markedly in the manner in which the code markings on the container are scanned, and also the method by which acceptable containers are processed and directed through the machine, or alternatively, rejected containers returned to the customer.

SUMMARY OF THE INVENTION

Accordingly, in order to eliminate or ameliorate the limitations and drawbacks encountered in prior art apparatus provided for the return of used containers, the present invention contemplates the provision of an improved redemption system and process for accepting the return of selected types of containers and for compensating the customer for the deposit therein of acceptable containers in a manner which is more selective than machines proffered by the prior art. Furthermore, the present invention provides for a more efficient treatment of acceptable returned containers and the rejection of nonacceptable containers and usage of available storage facilities for returned containers.

One preferred embodiment of the invention contemplates the provision of a redemption system and process for accepting the return of selected types of containers and compensating the customer for the deposit therein of an acceptable container. The redemption system includes an open carousel turntable rotatable about a vertical axis and including a plurality of circumferentially spaced compartments thereon in which there are placed returned containers by a customer with code markings in the containers facing radially outwardly from the carousel. A scanner in the apparatus is positioned adjacent to the carousel and is adapted to scan the code markings on the container as the carousel rotates the radially outwardly oriented markings past the scanner. The redemption system is responsive to the scanning device to selectively accept or reject each container, and includes a shredder for shredding acceptable returned containers, thereby minimizing the volume required for storage of returned containers and preventing additional deposits from being collected on the same container.

In accordance with a preferred embodiment of the invention, the redemption system includes an actuatable accept element or pivot arm for sweeping acceptable containers from the carousel, which arm is pivotally mounted adjacent thereto and circumferentially spaced from the scanner. A reject element or pivot arm for sweeping an unacceptable container from the carousel is pivotally mounted adjacent to the carousel and circumferentially spaced relative to the container accept arm. Furthermore, in accordance with the teachings of the preferred embodiment of the invention, the accept arm is selectively actuated by a solenoid in response to the output of the scanner to sweep only acceptable containers from the carousel, whereas the reject arm is automatically operated each time a circumferentially separated container compartment rotates thereby so that any container which has not been previously sweep from the carousel by the accept arm is swept therefrom by the reject arm.

Moreover, the present invention contemplates a redemption system of the type described wherein an accept chute is positioned below the carousel for directing acceptable containers swept from the carousel by the accept arm to the shredder, and a reject chute positioned below the carousel for directing containers swept therefrom by the reject arm to a reject receptacle or basket at the front of the redemption center for removal by the customer. Furthermore, in accordance with the teachings of the preferred embodiment a vertically positioned baffle is placed internally within the carousel to assist in ensuring that a container swept off the carousel by either the accept or reject arms is directed into the appropriate chute.

In further aspects of the invention, a plurality of cam rollers are mounted so as to be circumferentially spaced about the carousel, one for each circumferentially separated container compartment, to cause the reject arm to be actuated each time a container compartment rotates therepast. Additionally, the carousel includes an annular base member having a centrally located aperture therein through which accepted and rejected containers are directed into the respective accept or reject chutes by radially inwardly sweeping movements of the accept and reject arms.

Accordingly, it is a primary object of the present invention to provide a novel redemption system which distinguishes between returned acceptable and nonacceptable types of containers, issues refunds, accrues debits, destroys containers, and which provides for the efficient and compact storage therein of acceptable returned containers.

Another object of the present invention is to provide a redemption system of the type described wherein a device or shredder arranged within the machine shreds or densifies and destroys acceptable returned types of containers for effecting the efficient storage of the comminuted containers in a storage bin.

Another object of the present invention lies in the provision of a novel redemption system having the capability of recording the number of returned containers of each type. Generally this is accomplished by providing separate counters within the machine, one for each distributor of acceptable types of containers. When the acceptable types of containers represent products from different distributors, the recorded information enables the refunds given by the machine to be debited against the appropriate distributors.

Still another more specific object of the present invention lies in the provision of a redemption system of the type described wherein the accept arm is selectively actuated in response to the output of a scanner indicating that the returned container is of an acceptable type, and in which the reject arm is mounted so as to be circumferentially spaced about the carousel from the accept arm to thereby remove all containers from the carousel not previously swept from the carousel by the accept arm.

BRIEF DESCRIPTION OF THE DRAWINGS

The foregoing and other objects and advantages of a novel container redemption system or machine constructed pursuant to the teachings of the present invention may be more readily understood by one skilled in the art, having reference to the following description of a preferred embodiment thereof, taken in conjunction with the accompanying drawings, wherein identical reference numerals are used to refer to like or similar elements throughout the several views; and in which.

DETAILED DESCRIPTION OF A PREFERRED EMBODIMENT

Figure 1:
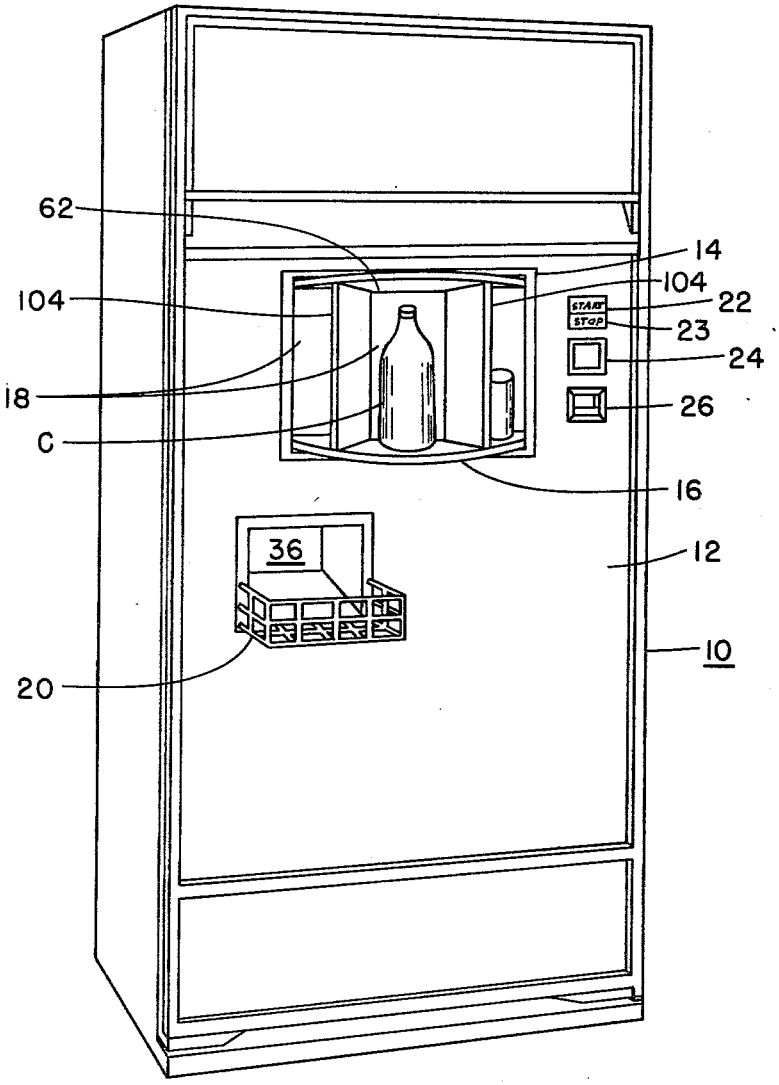
FIG. 1 is a frontal perspective view of one embodiment of a container redemption system constructed pursuant to the teachings of the present invention.

Referring to the drawings in detail, and particularly FIG. 1 thereof, a redemption system 10 is illustrated in a frontal perspective view, and includes a front panel 12 having a large rectangular opening 14 therein through which there projects a circular carousel turntable 16 rotatable about a vertical axis having circumferentially separated compartments 18 spaced thereabout into each of which a customer positions a returnable container C. If the container is not one of several acceptable types, it is adapted to be returned to the customer in a return basket 20 supported at the front of the machine, and in a manner described hereinbelow. A start button 22 is provided in the upper right corner of the front panel of the machine to initiate its operation. A stop or refund button 23 is also provided on the front panel, and during a normal operational cycle of the machine a customer presses the stop button to obtain a refund after he has deposited all returned containers within the machine. Arranged immediately below the start button are, respectively, a counter 24 for indicating to the customer the total value of returned containers, and a refund issuing slot 26 through which the customer receives either a cash refund or a printed receipt which may be redeemed by the customer for its face value, depending upon the particular design of the redemption system.

Figure 2:
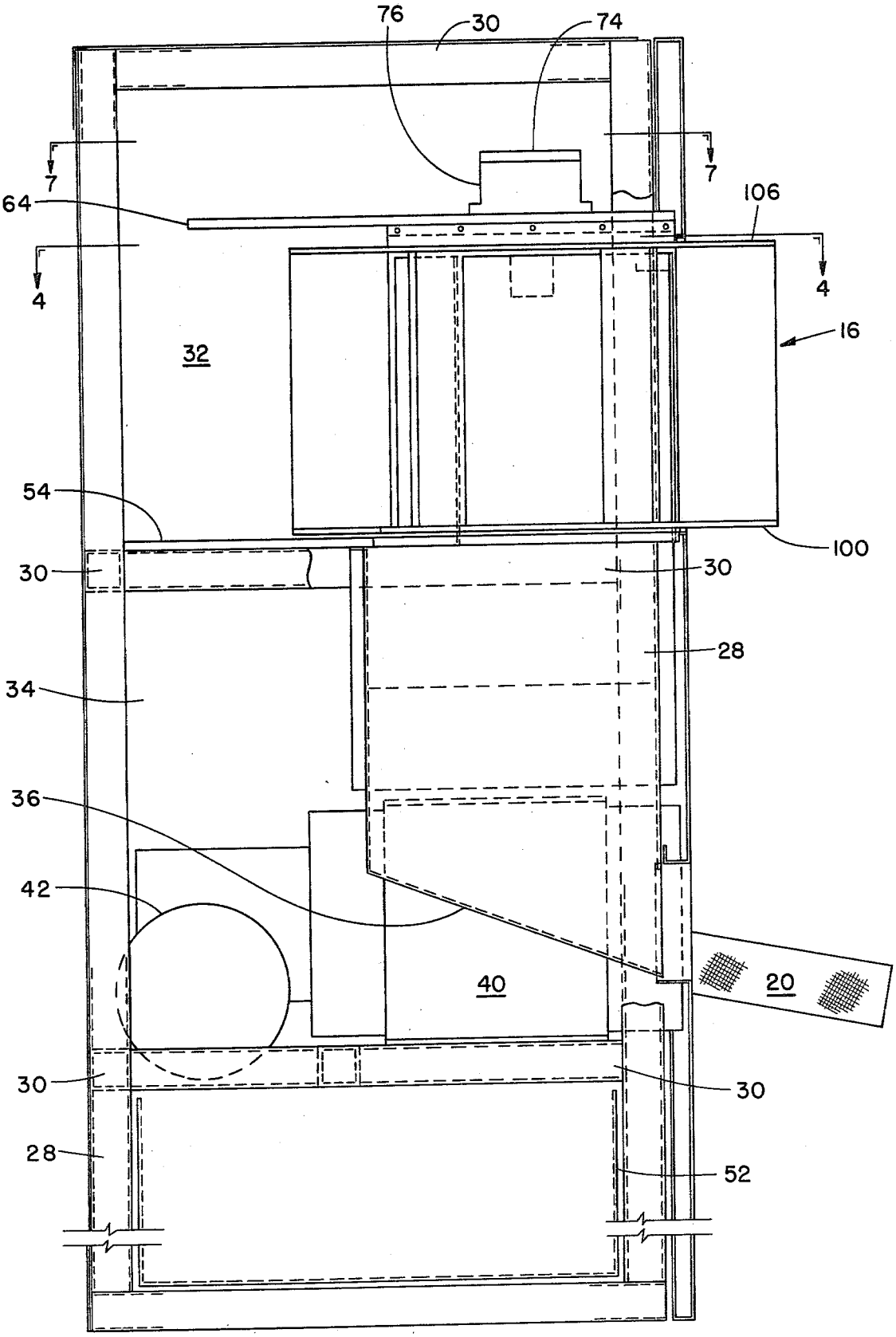
FIG. 2 is a side elevational view of the system shown in FIG. 1 illustrating several of the major internal components thereof in phantom lines.

FIG. 2 illustrates a side elevational view of the redemption system 10, with several of its major components being shown in phantom. Frame members for the apparatus include vertically upstanding support members 28 extending from top to bottom at each corner of the system, and horizontally arranged frame members 30 extending along the front, back and side surfaces of the system and being suitably secured to the corner frame members, such as by welding. The horizontally extending peripheral frame members serve to provide support for major components of the redemption system. The arrangement is divided by its frame members into a top compartment 32 in which there is located the carousel turntable 16, a middle portion 34 containing a reject chute 36 and an accept chute 38 for directing the processed containers to appropriate outlets, and a shredding device 40 or other suitable device for densifying and destroying or shredding acceptable types of containers. The device may be constituted of a commercially available shredder unit, and includes a driving motor 42 for a plurality of interdigitating blades 44, 46 mounted for opposed rotation about two adjacent parallel spaced drive shafts 48, 50 which serve to shred the accepted deposited containers for efficient and compact storage. A bin 52 or container is positioned below the shredder in the bottom section of the system for storing the shredded segments or pieces of the containers during intervals between servicing operations when the bins are periodically emptied.

Figure 3:
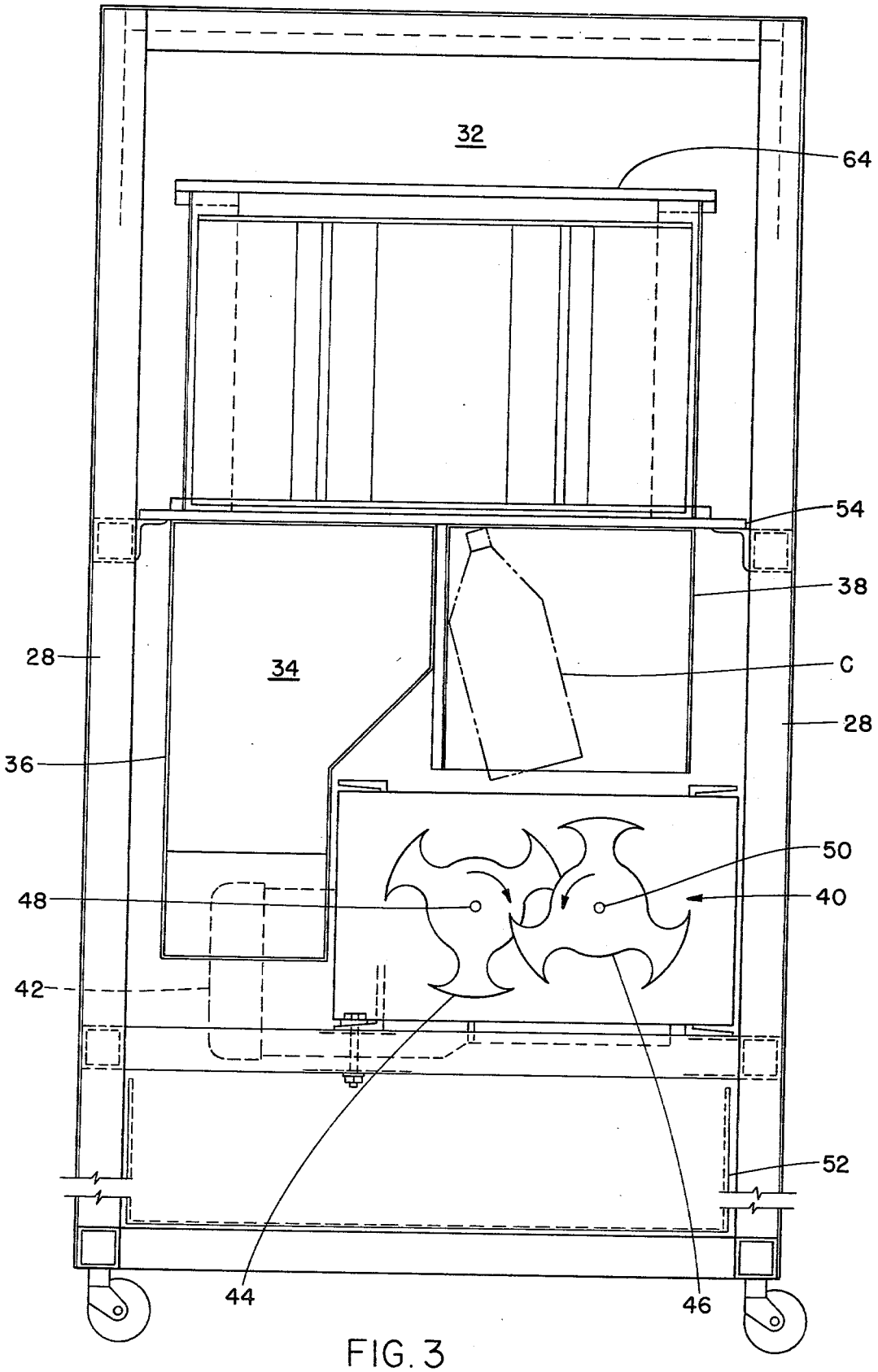
FIG. 3 is a front elevational view of the redemption system shown with its front panel removed, illustrating the locations therein of several of the major operative components of the apparatus.

FIG. 3 is a front view of the redemption system with its front panel shown removed, and illustrates the location of the reject chute 36 which directs an unacceptable container to the reject cage or basket 20 and the location of the accept chute 38 which directs acceptable containers to the shredder.

Figure 4:
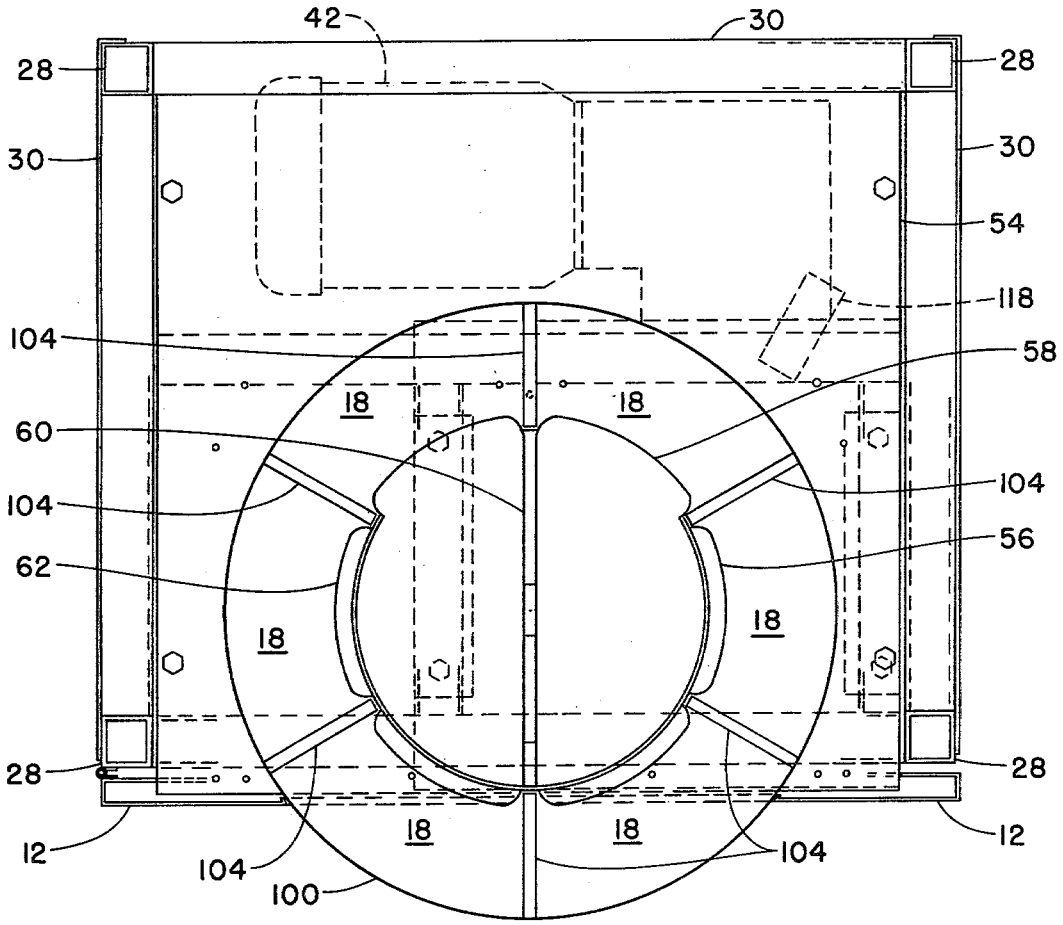
FIG. 4 is a sectional view taken along line 4—4 in FIG. 2, illustrative of further details of the carousel turntable and, additionally, the location within the system of several major operative components.
Figure 6:
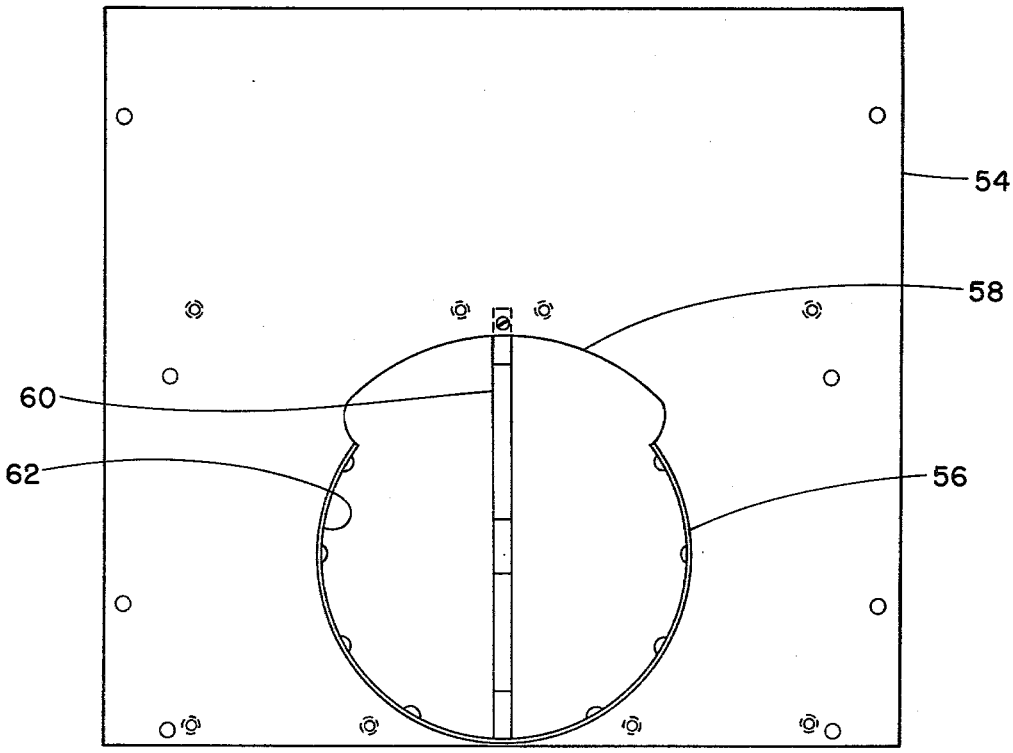
FIG. 6 is a top plan view of a horizontally disposed base member of the apparatus and several associated members.

FIG. 4 is a top view of the carousel turntable 16 and the base plate 54 positioned therebelow, and FIG. 6 illustrates a view of the base plate with the carousel removed therefrom.

The base plate member 54 may be constructed from aluminum plate stock, and has a large aperture 56 formed therein which is substantially circular in shape, with the exception of the rearward portion 58 thereof which is formed with a larger diameter in the left and right rear quadrants of the aperture. A vertical baffle member 60, which may be constructed of aluminum plate stock also extends from the front to the back of the apparatus and is positioned interiorly of and below the carousel unit. The vertical baffle 60 is centrally positioned in the base plate aperture, with the arrangement being such as to allow containers to be directed through the right half of the aperture to the accept chute 38 or the left half of the aperture to the reject chute 34.

A substantially U-shaped (from a top view) sheet metal plate 62 extends the height of the carousel, and is attached, such as by riveting, to the inner front portion of the base plate aperture and the front edge of the vertically extending baffle. The carousel rotates (counterclockwise as viewed from above) about the U-shaped sheet metal baffle 62, with the baffle forming a stationary inner wall adjacent to the rotating carousel. The U-shaped baffle is visible to a customer placing a returnable container on the carousel turntable, and effectively denies access by a customer to the inside of the redemption system 10.

Figure 7:
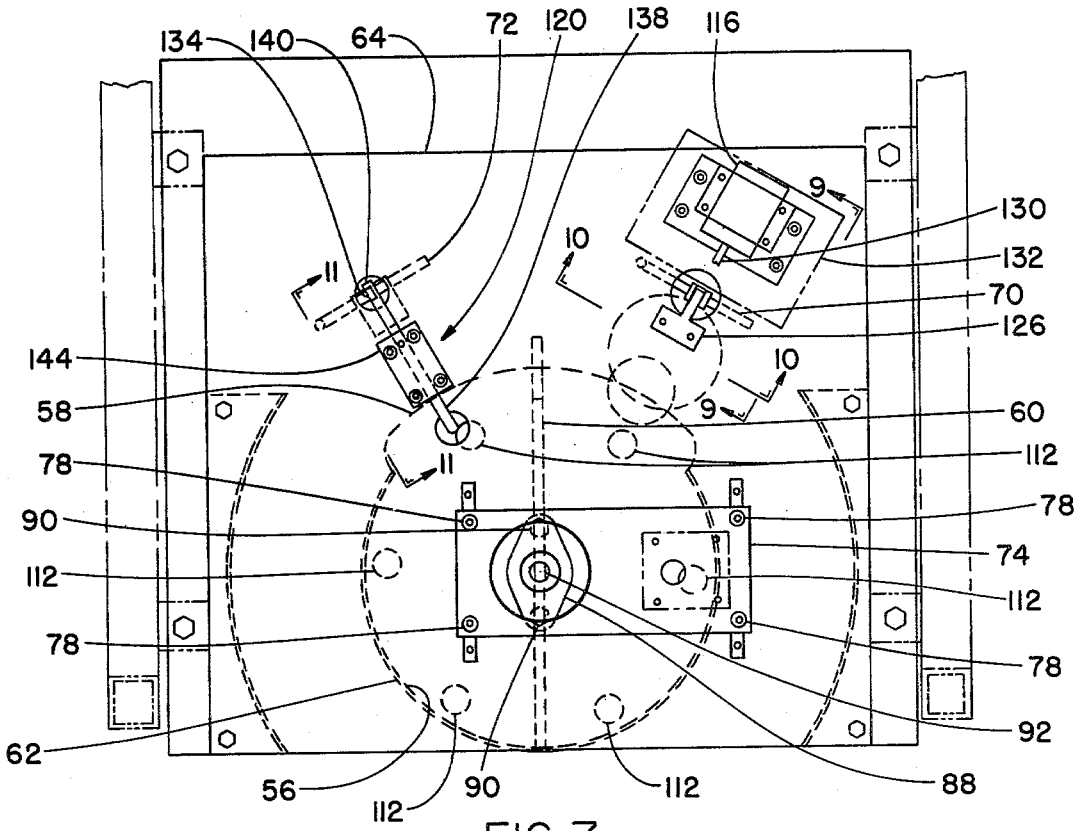
FIG. 7 is a view taken along line 7—7 in FIG. 2, and illustrates details of the drive mechanism for the carousel unit, including details of the actuating mechanisms for both the accept and reject arms in the system.
Figure 8:
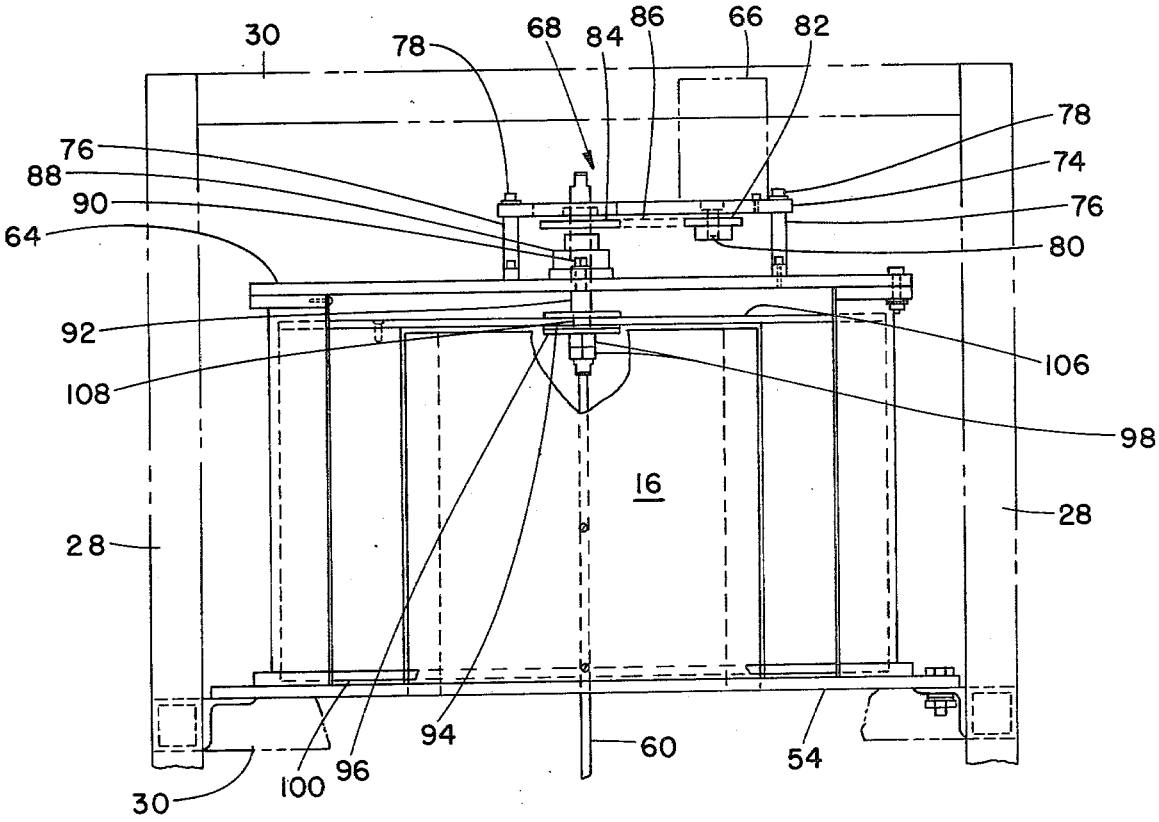
FIG. 8 is a front elevational view of the carousel and its associated support and drive members.

FIG. 7 is a top view of a mounting plate 64 which supports the motor 66 and drive mechanism 68 for the carousel and also the actuating mechanisms for both an accept sweeper arm 70 and a reject sweeper arm 72. The mounting structure for the carousel drive 68 includes a substantially rectangular motor base plate 74 which is retained in spaced relationship above the mounting plate by a pair of spacer elements 76 which extend between the mounting plate and the base plate. Four corner bolts 78 extend through this assembly, as shown in FIGS. 7 and 8, to securely fasten all of the components together. The vertically positioned electric gear motor 66 is centrally mounted at one end of the motor base plate, with its shaft 80 extending therebelow. A first sprocket 82 is secured to the end of the motor shaft while a second sprocket 84 is secured to a support shaft for the carousel, and a chain drive 86 extends between the two sprockets so as to enable the motor to rotatively drive the carousel 16. A flange unit 88 is mounted to extend about the carousel drive shaft and is securely attached by suitable bolts 90 to the mounting plate 64 in order to support the carousel through its shaft for rotational movement. The carousel shaft 92 extends downwardly to the carousel unit to which it is attached by means of a friction disc 94, a mounting disc 96 and a number of lock nuts 98. The friction disc 94 allows for rotational slippage between the shaft 92 and the carousel unit 16 in the event that the carousel is jammed against rotational movement, such as by a container not being properly placed thereon, or by a customer getting his hand caught in the apparatus.

Figure 5:
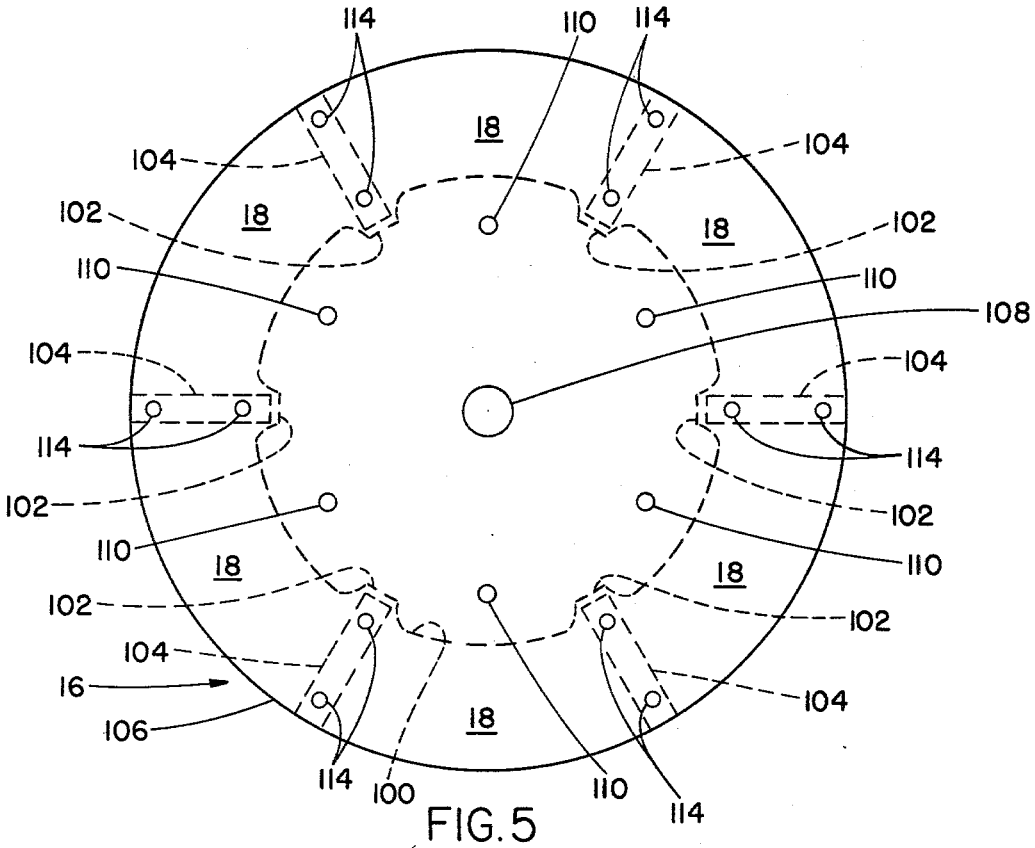
FIG. 5 is a top plan view of only the carousel turntable, illustrating the details of construction thereof.

FIGS. 2 through 5 illustrate details of the rotating carousel turntable 16, which includes an annular shaped bottom ring member 100 having six radially inwardly extending protuberances 102 at which there are positioned vertically and radially extending, rectangularly shaped, spacer elements 104. The six radially extending spacer elements extend up to a circular top plate 106 shown which has a centrally located aperture 108 formed therein, through which there extends the drive shaft 92 for the carousel and is mounted as explained hereinabove. The six spacer elements 104 divide the carousel into six container compartments 18 adapted to have returnable containers C placed therein. The top plate member has six circumferentially spaced holes 110 formed therein, each of which mounts a cam roller 112, as shown in further detail in FIG. 11. The cam rollers 112 function to actuate the reject arm 72 in a manner as will be explained hereinbelow. The annular shaped bottom ring member 100, the spacer elements 104 and the round top plate member 106 may all be formed from aluminum plate stock, and fastened together appropriately as by flat head machine screws through fastening apertures 114 as shown in FIG. 5.

During operation of the redemption system, each container compartment 18 in the carousel 16 first rotates past the accept arm 70 which is selectively actuated by a solenoid 116 in response to the detection and scanning of a UPC code on an acceptable type of container. A scanner 118 which may be a laser scanner scrans the UPC code, and if the container is determined to be an acceptable type by a detector unit within the scanner, the accept arm solenoid 116 is actuated, thereby causing the accept arm 70 to sweep the container radially inwardly from its position in the compartment of the carousel through the right quadrant opening in the base plate 54, and to drop into the accept chute 38 which directs the container to the shredder 40. The container compartment 18 continues its rotation to the left rear quadrant of the machine at which the reject arm 72 is positioned. Consequently, acceptable containers C are removed from the carousel by the accept arm prior to rotation of the container compartment 18 past the reject sweep arm.

The reject arm is actuated by a cam mechanism 120 located about the periphery of the carousel unit in a continuous sequence in which it is automatically operated each time a container compartment on the carousel rotates past the reject arm 72, irrespective of the presence of a container in the carousel compartment.

Figure 9:
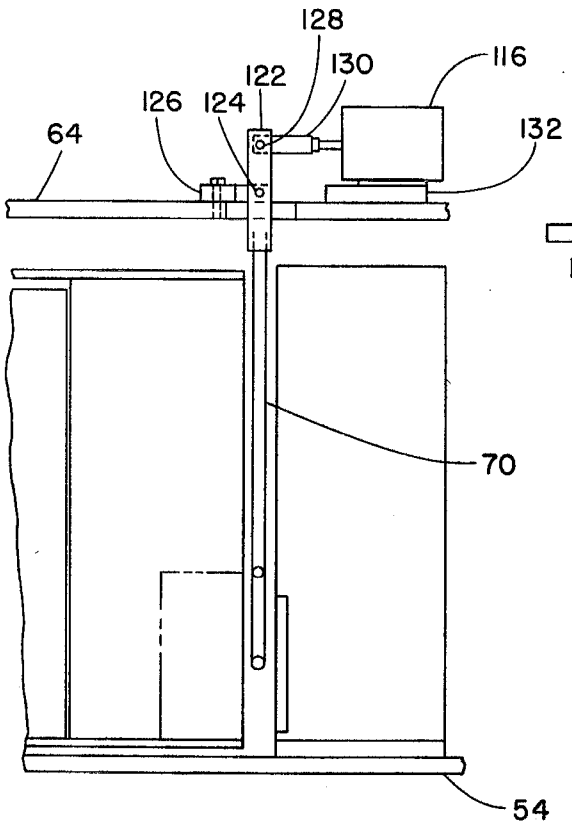
FIG. 9 is a view along line 9—9 in FIG. 7, illustrating further details of the solenoid-actuated drive mechanism for the container accept arm.
Figure 10:
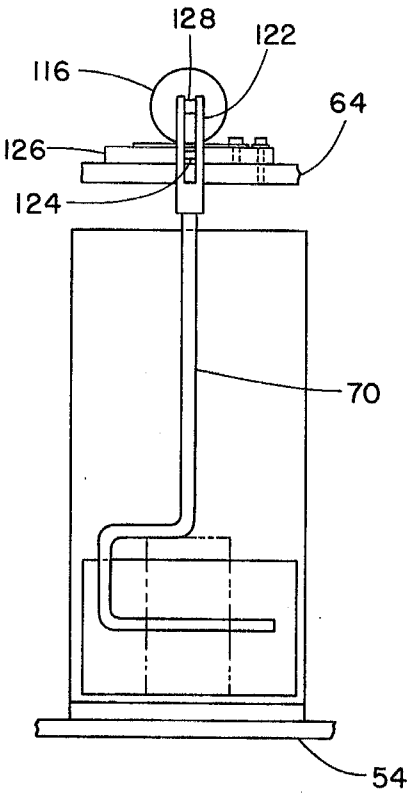
FIG. 10 is a view taken along line 10—10 in FIG. 7, illustrative of the container accept arm and its actuating solenoid-actuated drive mechanism.

Details of the accept sweep arm actuating mechanism are illustrated in FIGS. 7, 9 and 10 of the drawings, wherein the arm is shown to be an elongated rod which is bent into the shape of a horizontally disposed U at its sweeping base and with the bottom leg of the U being of an elongated length. The accept arm terminates at its upper end in a pivot element 122 pivotally mounted about dowel 124, which is supported by a pivot base 126 securely mounted as by bolts to the top of the mounting plate 64. The pivot element has a second dowel 128 extending transversely through its upper end, to which there the shaft 130 of an electric solenoid 116 is pivotally connected. The solenoid is mounted through the intermediary of a base plate 132 to the mounting plate 64, and is positioned radially outwardly from the accept arm 70 relative to the carousel. The solenoid is of the retraction type such that an electrical pulse applied to its coil effects a retraction of its shaft 130, thereby pivoting the accept arm about its dowel pivot point 124 and causing the lower end thereof to sweep radially inwardly. The moving arm sweeps an acceptable container from the carousel through the right quadrant opening in the base plate 54 into the accept chute 38, which directs the container towards and onto the comminuter blades 44, 46 of the shredder 40.

Figure 11:
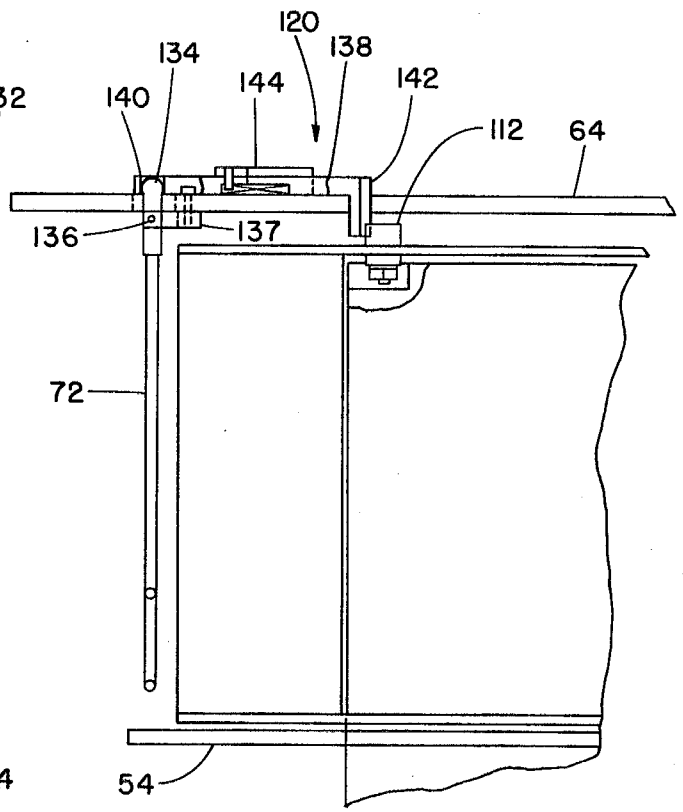
FIG. 11 is a partly sectioned view taken along line 11—11 in FIG. 7, illustrating further details of construction of the cam-operated drive mechanism for the container reject arm.

Operation of the container reject arm 72 is best understood by reference to FIGS. 7 and 11. The reject arm includes a rod similar in shape to that of the accept arm 70, and terminates at its upper end in an element 134 which is pivotally mounted by a dowel 136 held in position by a pivot base 137 securely fastened by bolts to the bottom of the mounting plate 64. A radially extending slide element 138 is mounted for radial translational movement along the upper surface of the mounting plate, and has an opening 140 formed at its outer radial end which extends about a knob on the top of upper element 134 of the reject arm. The slide element 138 also has a downwardly extending cam follower element 142 formed at its radially inner end. A radially extending slide element retainer 144 having a longitudinal channel formed therein along its length is bolted to the mounting plate about the slide element so as to allow for radially translational movement of the slide element across the upper surface of the mounting plate 64 under the control of the cam followers 112. The cam follower 142 is actuated for outward radially translational movement by the six cam rollers 112, one for each container compartment on the carousel, and which are spaced circumferentially about the top of the carousel unit. As the carousel is rotated, the cam rollers 112 are sequentially moved into contact with the cam follower 142, and the slide element is translated radially outwardly, thereby causing the reject sweep arm 72 to pivot about its dowel pivot point 136. The bottom of the reject arm 92 is thereby caused to sweep inwardly in a radial arc, displacing any container present in the container compartment 18 from the carousel through the left quadrant opening of the base plate 54 to thereby drop into the reject chute 36. The reject chute 36 then directs the unacceptable or rejected container to the reject basket 20 at the front panel of the redemption apparatus for recovery by the customer.

Figure 12:
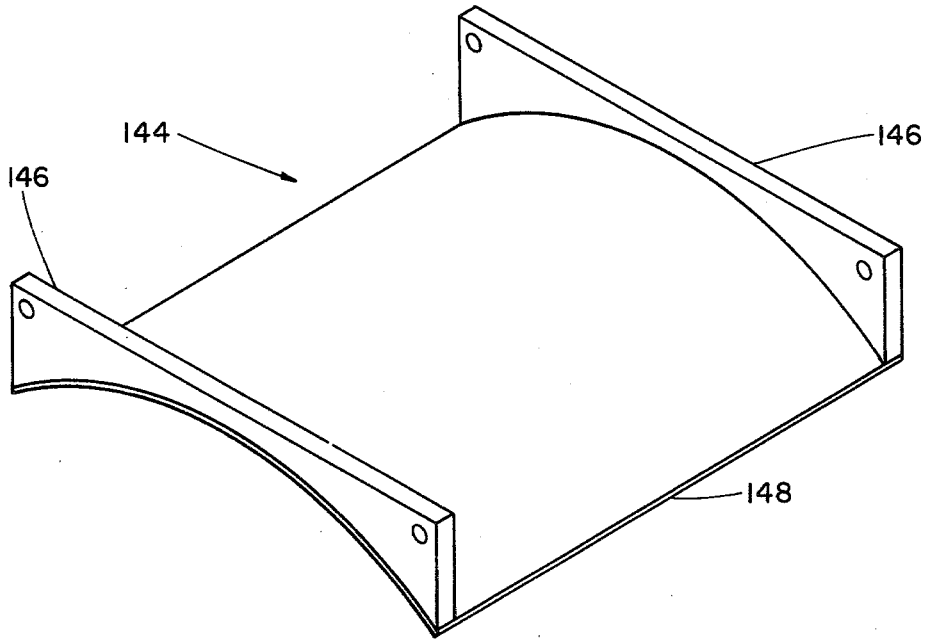
FIG. 12 is a perspective view of one of two side plates, with its supporting frame members, which are positioned on each side of the rotating carousel member.

FIG. 12 is a perspective view of one of the assemblies 144 which are positioned radially outwardly of the carousel 16 on each side thereof. Each spacer assembly 144 includes top and bottom frame elements 146 having an inner curved surface with the curvature conforming to the outer curvature of the carousel. The top and bottom frame elements may be appropriately formed from stock aluminum. A sheet metal member 148 is fastened, for example by riveting, to the inner curved surface of each of the frame members 146, and the spacer assembly is then secured through the intermediary of its frame members within the redemption system.

Figure 13:
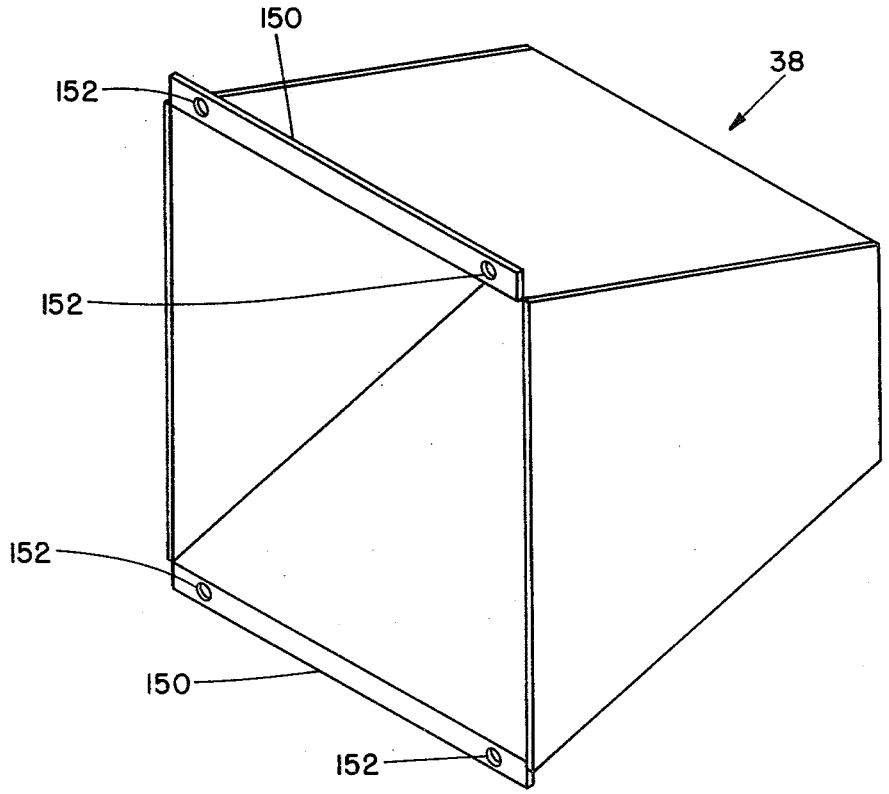
FIG. 13 is a frontal perspective view of the accept chute for directing acceptable containers to the shredder swept from the carousel member by the container accept arm.

FIG. 13 is a perspective view of the accept chute 38 which may be formed of sheet metal in the shape of a relatively square funnel. Two of the upper sides of the accept chute have outwardly extending flanges 150 with holes 52 therein by means of which the accept chute is secured to the base plate 54. The accept chute is positioned within the redemption apparatus below the right side portion of the aperture in the base plate, with its bottom or outlet being positioned above the comminuter blades of the shredder 40 so as to direct the accepted containers to the latter.

Figure 14:
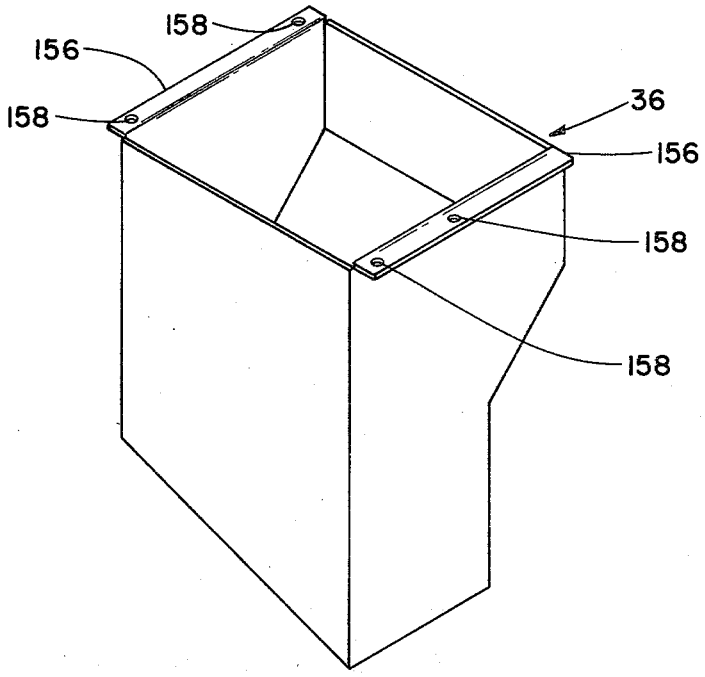
FIG. 14 is a frontal perspective view of the container reject chute for directing rejected containers to the reject basket at the front of the redemption center for return to a customer.

FIG. 14 is a perspective viewpoint of the reject chute 36 which, similar to the accept chute, may also be formed of sheet metal, and which is positioned below the left half of the aperture in the base plate 54. Two of the upper sides of the reject chute have outwardly extending flanges 156 with holes 158 drilled therein through which the reject chute is secured to the base plate 54. The reject chute directs unacceptable containers to the reject cage 20 at the front panel of the redemption system.

Figure 15:
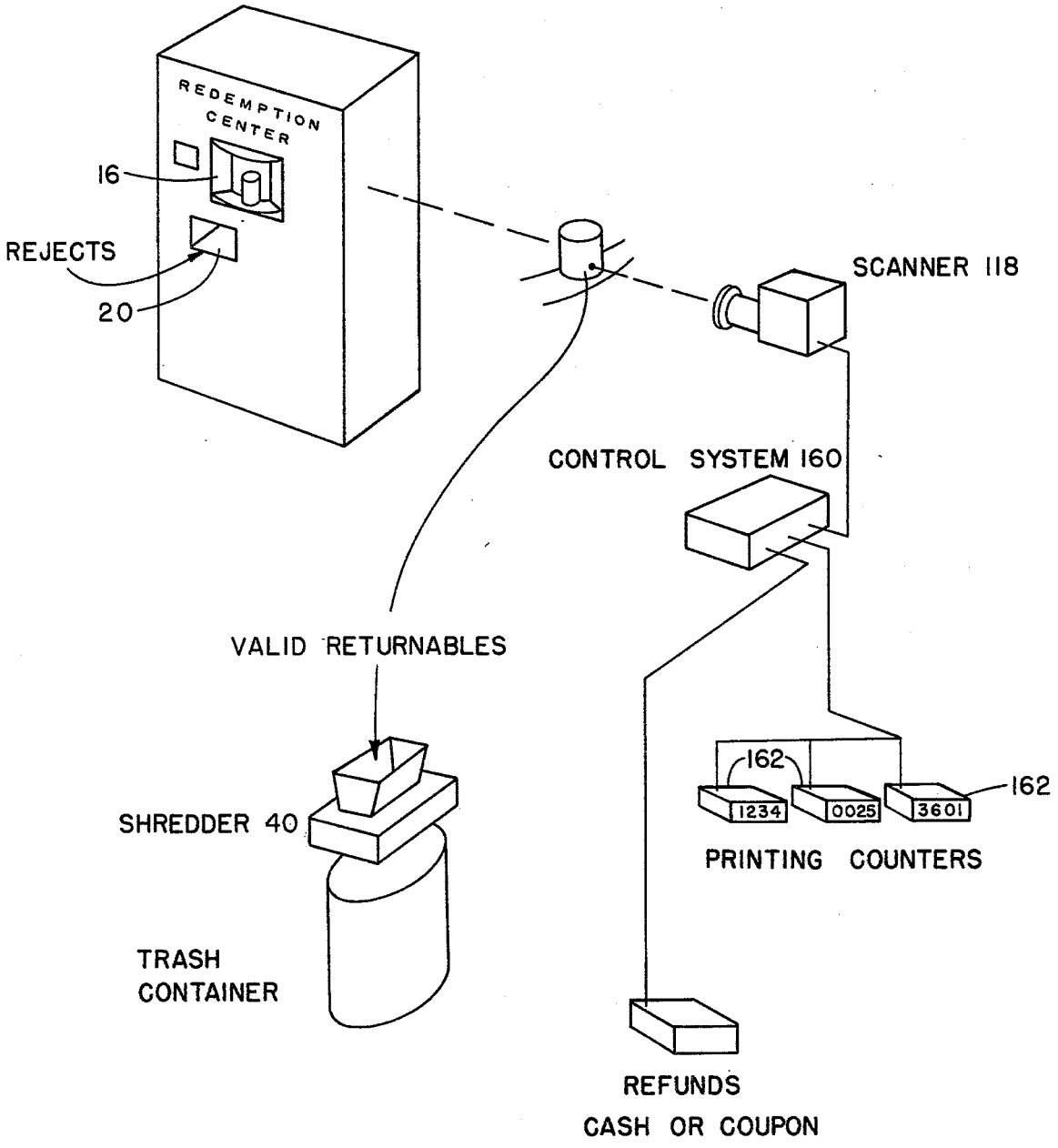
FIG. 15 is a conceptual diagram of various functional operations performed in the redemption system.

FIG. 15 illustrates conceptually the various functional operations performed by the redemption center. The scanner 118 detects the code on a returned container, and the detected information is directed to a control system 160. If the container is one of an acceptable type, a counter 162 for that type of container is indexed one count. In a preferred embodiment of the machine, each counter may be a non-resettable printing-type counter, whereby it keeps a record of the number of returned containers of that type. When acceptable types of containers represent products from different distributors, the recorded information enables the refunds given by the machines to be debited against the appropriate distributors. After a customer deposits all returned containers within the machine, the stop button 23 is pressed to obtain either, depending upon the machine design, a cash refund or a credit slip redeemable for the face value printed thereon for the value of all of the returned containers. In one preferred embodiment of the invention, the control system 160 may be a microprocessor which is programmed in a straightforward manner, and has stored in memory information on the appropriate UPC codes for different acceptable types of containers. The memory stores information on UPC codes for acceptable types of containers in a given geographical area, and the microprocessor controls the flow and storage of information within the redemption center.

Figure 16:
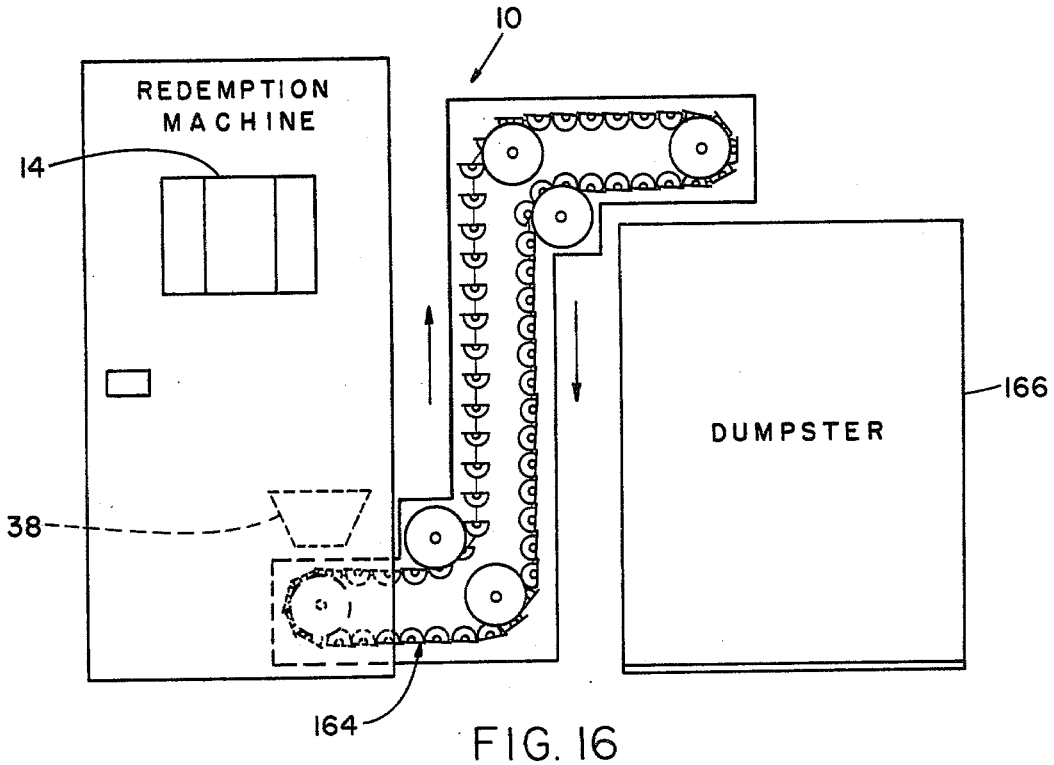
FIGS. 16 and 17 illustrate second and third further embodiments of redemption systems wherein the returned containers are stored in scrap bins or dumpsters positioned adjacent to the systems.

FIG. 16 illustrates a second embodiment of a redemption center wherein the shredder is eliminated and acceptable returned containers are directed by the accept chute 38 onto a bucket elevator or conveyor 164 which conveys them to a storage bin 166 located in the proximate area of the machine for storage of the returned containers. An appropriate type of bucket elevator for use with this embodiment is manufactured by Aseeco Corporation, Beverly Hills, Calif. 90211. Alternatively a comminuter or shredder may also be utilized in this embodiment, and the conveyor utilized to convey comminuted scraps to the bin. In these embodiments the storage bin 166 may be of the dumpster type to enable convenient handling of the returns.

Figure 17:
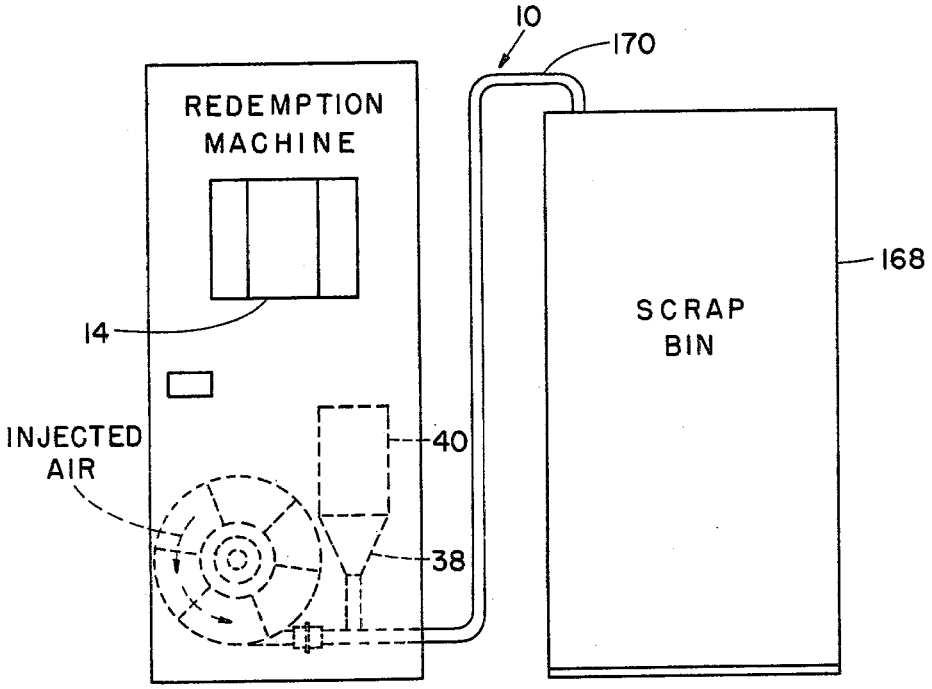

FIG. 17 illustrates another embodiment of a redemption machine wherein returns from acceptable containers are again stored in a scrap bin 168 located proximate to the redemption machine. In this embodiment the comminuted or densified and destroyed container scraps are pneumatically conveyed to the bin via a pneumatic line 170 directed from the output of the shredder 40 to the scrap bin. The pneumatic conveying machine may be of the type sold under the trademark QUICKDRAFT, described with greater particularity in U.S. Pat. Nos. 3,165,257 and 3,181,646.

Although one preferred embodiment of a redemption system has been described in detail, it is readily apparent that other embodiments may be constructed within the teachings of the present invention, and that the disclosure herein will suggest many alternative embodiments to those skilled in the art.

What is claimed is:

1. A method of accepting the return of selected types of containers, comprising the following steps:

(a) causing relative movement between a returned container, having a code thereon, and a code scanner;

(b) scanning the code marking on the container;

(c) selectively accepting or rejecting the container depending upon the code markings thereon;

(d) densifying and destroying acceptable returned containers;

(e) storing the destroyed remains of acceptable containers in a storage bin; and (f) issuing a cash return or redeemable coupon to a consumer; and recording the number of returned containers, as indicated by the code thereon, to accrue a debit to the distributor of that type of returned container.

2. A method as claimed in claim 1, including the steps of storing the returns of acceptable containers in a remote storage bin, said step of destroying includes the step of shredding acceptable returned containers in a comminuter, and conveying the remains of the containers from said comminuter to said remote storage bin.

3. A method as claimed in claim 2, wherein said step of conveying includes the step of pneumatically conveying the remains of containers to said storage bin.

4. A method as claimed in claim 2, wherein said step of conveying includes the step of mechanically conveying the returns of accepted containers to said storage bin.

5. A redemption system for accepting the return of selected types of containers and for compensating the customer for the deposit therein of accepted containers, comprising:

(a) an open carousel including a turntable in which a returnable container is adapted to be positioned with a code thereon facing radially outwardly from the carousel;

(b) scanning means positioned adjacent said carousel for scanning the code markings on the container as the carousel rotates the radially outwardly directed markings past the scanning means;

(c) means responsive to the output of said scanning means for selectively accepting or rejecting the container; and (d) a plurality of counters, one for each distributor of an acceptable type of container, whereby each counter maintains a record of the number of returned acceptable containers of the type monitored by that counter.

6. A redemption system as claimed in claim 5, comprising a shredder for shredding acceptable returned containers.

7. A redemption system as claimed in claim 5, comprising an accept actuating element pivotally mounted adjacent to said carousel and circumferentially spaced around the carousel from said scanning means for sweeping an acceptable container from the carousel into said apparatus.

8. A redemption system as claimed in claim 7, said carousel turntable having a plurality of circumferentially separated compartments.

9. A redemption system as claimed in claim 7, including solenoid means responsive to the output of said scanning means for selectively actuating said accept element.

10. A redemption system as claimed in claim 7, including:

(a) a reject element pivotally mounted adjacent to said carousel and circumferentially spaced around the carousel from said accept element;

(b) a reject chute for receiving containers rejected by said apparatus; a reject outlet on said apparatus communicating with said reject chute for returning nonacceptable containers to a customer; and (c) means for causing said reject element to pivotally sweep across said carousel each time a circumferentially separated compartment rotates therepast, whereby any container which has not been selectively removed from the carousel by said accept element is swept from the carousel by said reject element and directed towards said reject chute.

11. A redemption system as claimed in claim 10, including cam means for actuating said reject element.

12. A redemption system as claimed in claim 11, said cam means including a plurality of cam rollers circumferentially spaced about said carousel; and a cam follower being mechanically coupled to said reject element, said reject element being actuated by each cam roller as said element is rotated past the cam follower.

13. A redemption system as claimed in claim 10, said carousel turntable including an annular base member having a central aperture, said accept and reject elements being adapted to sweep a container off said carousel in a radially inward direction through said central aperture.

14. A redemption system as claimed in claim 13, comprising a vertically extending baffle member positioned internally of said carousel turntable and serving as a divider between containers dislodged from the carousel by said accept element and containers dislodged from the carousel by said reject element.

15. A redemption system as claimed in claim 14, comprising an accept chute positioned below said carousel for directing containers dislodged from said carousel by said accept element; and a reject chute positioned below said carousel for directing containers dislodged from said carousel by said reject element to a reject receptacle on said apparatus.

16. A redemption system as claimed in claim 15, including means for densifying and destroying acceptable returned containers, positioned below said accept chute, whereby containers dislodged from said carousel by said accept elements are directed by said accept chute to said destroying means.

17. A redemption system as claimed in claim 5, including means for densifying and destroying acceptable returned containers.

18. A redemption system as claimed in claim 17, including a storage bin located separately from the other aforementioned components, and a conveyor means for conveying the remains of acceptable returned containers to said storage bin.

19. A redemption system as claimed in claim 18, including a pneumatic conveyor for conveying the remains of comminuted containers to said storage bin.

20. A redemption system as claimed in claim 5, including a storage bin located separated from the other aforementioned components, and a conveyor means for conveying acceptable returned containers to said storage bin.

21. A redemption system as set forth in claim 20, wherein said conveyor means includes a mechanical conveyor having a plurality of load bearing elements on a common conveyor belt.

* * * * *